United States Patent [19]

Humphrey

[11] Patent Number: 4,663,611

[45] Date of Patent: May 5, 1987

[54] ALARM LOCK

[76] Inventor: Chris W. Humphrey, 18 Hobart Crescent, Nepean, Ontario, Canada, K2H 5S4

[21] Appl. No.: 463,316

[22] Filed: Feb. 2, 1983

[30] Foreign Application Priority Data

Oct. 15, 1982 [CA] Canada ..... 413,517

[51] Int. Cl.[4] ..... E05B 45/06

[52] U.S. Cl. ..... 340/542; 340/63; 340/691; 340/825.48; 70/DIG. 49

[58] Field of Search ..... 340/542, 63, 64, 548, 340/65, 691, 539, 506, 825.47, 825.48, 384 E, 384 R; 70/18, DIG. 49

[56] References Cited

U.S. PATENT DOCUMENTS

| | | | |
|---|---|---|---|
| 3,614,763 | 10/1971 | Yannuzzi | 340/691 X |
| 3,683,346 | 8/1972 | Horton | 340/691 X |
| 3,824,540 | 7/1974 | Smith, II | 340/63 |
| 3,879,721 | 4/1975 | Yereance | 340/65 X |
| 3,993,987 | 11/1976 | Stevens | 340/542 |
| 4,206,448 | 6/1980 | Davis | 340/384 E |
| 4,271,405 | 6/1981 | Kitterman | 340/548 X |

FOREIGN PATENT DOCUMENTS 2823097 11/1979 Fed. Rep. of Germany .

OTHER PUBLICATIONS

"Multi—Option Siren", Radio and Electronics Constructor, vol. 33, No. 12, Aug. 1980, pp. 702, 703.

*Primary Examiner*—James L. Rowland
*Assistant Examiner*—Jeffrey A. Hofsass
*Attorney, Agent, or Firm*—Alan H. Levine

[57] ABSTRACT

This invention is an alarm lock which uses a key-releasable cable to secure an article to be protected to a fixed object. Should the cable be cut, a coded audio alarm is emitted, alerting the owner of the article. The cable contains a conductor which is connected to an alarm circuit sensitive to a resistance in series with the cable. Attempts to defeat the cable by jumpering or cutting or otherwise varying the resistance causes the alarm to be set off. Pulling the cable (tampering) also causes the alarm to operate, for a fixed period of time. The lock unit can be fixed to the handle bars of a bicycle and the alarm sound can be generated manually whereby it can be used as a horn.

8 Claims, 7 Drawing Figures

ALARM LOCK

This invention is a lock useful to protect a bicycle or other article which, when tampered with, emits an alarm, notifying its owner of possible theft.

While shackle locks have been used for many years to secure articles such as bicycles, skis, briefcases, etc. to a fixed object such as a fence or the like, in recent years flexible cable locks have become popular. Flexible cable locks utilize a chain or flexible steel cable which locks in a loop, usually releasable by mechanical tumblers of a combination lock. Examples of such locks may be found in U.S. Pat. No. 3,611,760 issued Oct. 12th, 1971, invented by R. M. Muther, and Canadian Pat. No. 595,042 issued Mar. 29th, 1960, invented by Louis E. E. Goesner.

However both shackle and cable locks suffer from an inherent disadvantage. A thief can cut the shackle or cable by means of a pair of wire or fence cutters, thus releasing the article to be protected.

A second shortcoming of existing cable locks is that they are often either too short to attach between distant articles (e.g. bicycle wheels) or too long to stow conveniently.

The present invention is a lock which uses a security cable which, if cut, causes the device to emit a loud alarm which, can either scare off the thief, or alert passersby of the tampering. Indeed, in the preferred embodiment, the alarm emits sound which is in the form of a predetermined code which can be established by the owner, thus alerting him of the theft of his personal goods. According to a further embodiment, the alarm can be manually operated, and thus can also be used as a horn.

As a feature of the present invention, the security cable is wound on a spring loaded reel. Should the cable be pulled by someone tampering with it and thereby unwinding the reel, either a constant or temporary alarm is sounded, thereby warning him away and alerting passersby or the owner. Yet the owner can release the cable by means of a key without setting off the alarm, any time he wishes. The likelihood of a thief making off with the protected goods in an undetected manner is thereby substantially reduced. However should a would-be thief cut the security cable, it can be easily and inexpensively replaced.

In general, the alarm lock of the present invention is comprised of a housing which is normally weatherproof containing an alarm circuit, a security cable including a conductor passing longitudinally through it, apparatus in the housing for retaining one end of the cable, apparatus is the housing for releasably retaining the other end of the cable, whereby the conductor is connected to arm the alarm circuit, the alarm circuit including circuitry for enabling the alarm circuit upon the security cable conductor being cut whereby an alarm sound is emitted. In the preferred embodiment the cable contains both an inner conductor and an outer jacket, having a predetermined resistance between them. Circuitry is provided for repetitively emitting a predetermined coded alarm sound upon the resistance between the inner conductor and outer jacket being varied by more than a predetermined amount.

A better understanding of the invention will be obtained by reference to the detailed description below in conjunction with the following drawings in which.

Figure 1:
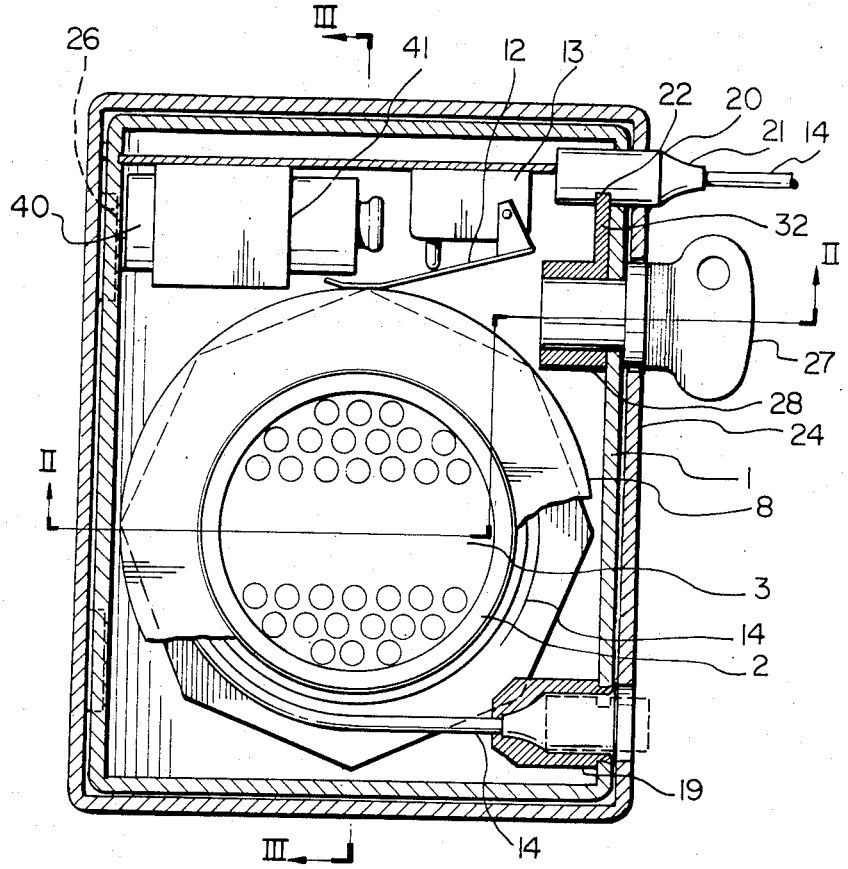
FIG. 1 is a horizontal section through the lock.
Figure 2:
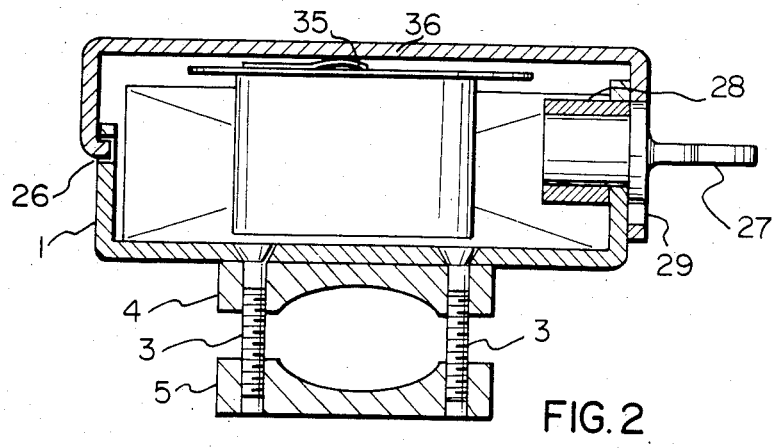
FIG. 2 shows the lock on section II—II of FIG. 1.
Figure 3:
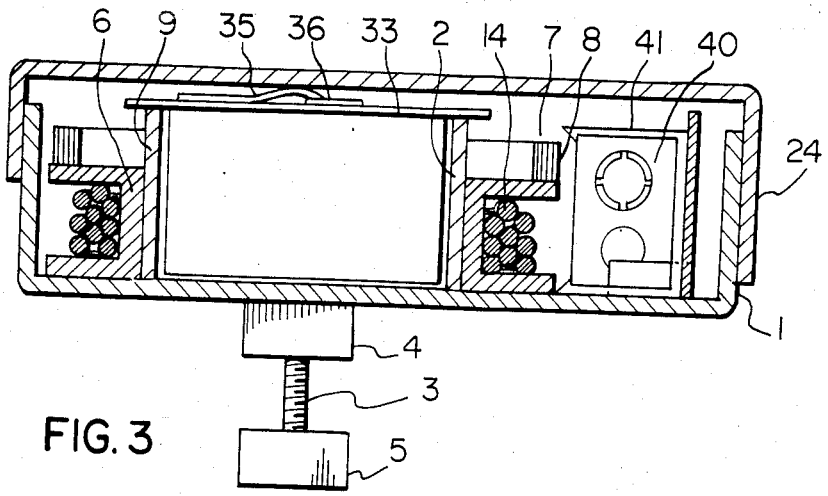
FIG. 3 shows the lock on section III—III of FIG. 1.
Figure 4:
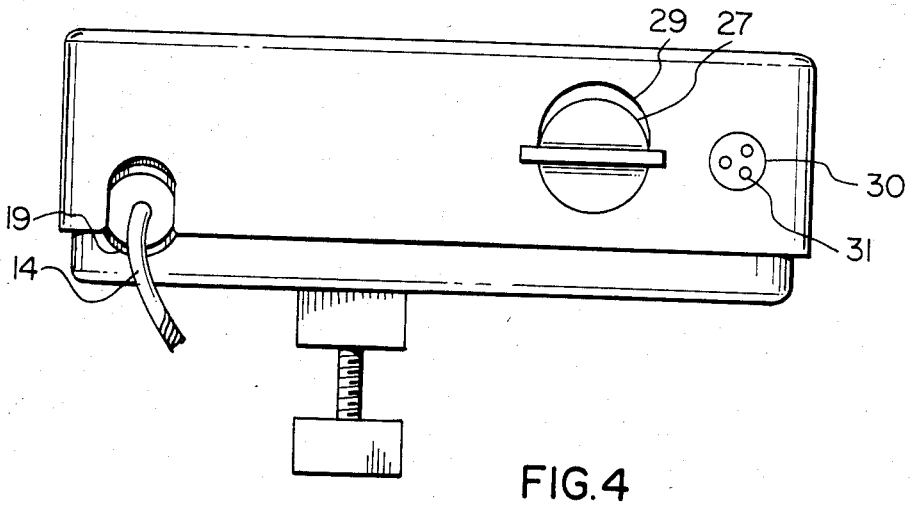
FIG. 4 shows a front view of a lock.

FIGS. 1–4 show the mechanical construction of an alarm lock which is of the form which can be attached to the handlebars of a bicycle, although it is emphasized that the invention is not limited to this application. FIGS. 1–4 should be considered together. A housing consists of a lower half 1, to which a pair of half clamps 4 and 5 is attached by means of a pair of screws 3. The screws pass from inside the lower housing 1 into tapped holes in half clamp 5. A spool 6 rotates upon a spool supporting structure 2 which is cast into or otherwise fixed upon the lower housing 1. A coil spring 7 is attached at one of its ends to the outer edge of one face 8 of spool 6, and to the supporting structure 2 at its other end 9. One face of the spool may be circular, but the other face such as the lower face, has truncated edges, i.e. has adjoining straight edges around its periphery. The number of straight edges is not critical, although approximately eight straight edges is preferred.

A microswitch 13 has a pivoting lever 12 which operates the switch to which it is swivelled, the end of the lever being biased against the straight edges of the truncated end (the straight edges) of spool 6.

A long cable 14, which forms the security cable, is wound upon the spool 6.

Figure 5:
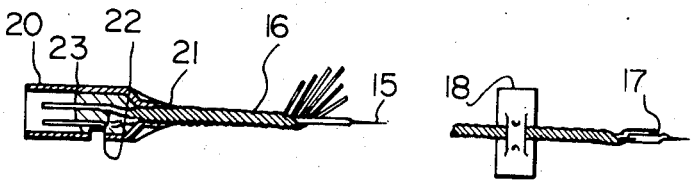
FIG. 5 shows the preferred form of the cable assembly.

Turning for a moment to FIG. 5, the cable is comprised of a fine insulated conducting wire 15, over which is woven a flexible jacket 16 of (conducting) steel wire. A resistor 17 connects the inner conductor to the outer steel jacket. The resistor end of the cable is mechanically attached to the inner diameter of the spool 6, the cable being wound around the spool. At a point on the cable at a short distance from the resistor 17 a smaller metal plate 18 is secured, as a strain relief. The cable is encapsulated in a flexible plastic material such as TEFLON (trade mark), which bonds the outer jacket to the inner insulating wire. The end of cable 14 remote from resistor 17 terminates in connector 20 which has resilient bushing 21 at its back and between it and the cable. The connector 20 contains three conducting pins, the inner wire 15 being connected to one pin (referred to herein as J3), and the outer jacket 16 being connected to the other two pins, referred to herein as J1 and J2. The connector 20 also has a groove 22 cut in it orthogonal to the axis of the cable.

Returning to FIGS. 1–4, cable 14 passes through a recessed bushing 19 which is retained in an opening in the lower housing 1. The coil spring 7 is tensioned to cause the spool 6 to rotate freely and pull the cable through bushing 19 until resilient bushing 21 contacts it and stops further winding of the cable on the reel. The cable can be fully withdrawn until the plate 18 prevents cable 14 from passing any further through bushing 19.

A cover 24 is hinged securely to the lower half of housing 1 at two points 26 on the rear face of the housing. The exact manner of hinging can be left to the designer, since its specific mechanical structure does not form part of this invention.

At the front face of the housing, diametrically opposite the hinged face, the top cover overlaps the lower housing almost completely. A hole 29 in the top cover allows a key 27 to be inserted into lock 28, which is attached to the lower housing 1. A circular section of the key 27 passes through the hole 29 (which is formed as an elongated slot in the cover 24), thus permitting the cover 24 limited movement in a vertical direction with respect to the lower housing 1 pivotted about hinges 26.

A connector 31 which mates with connector 20 is located in lower cover 1, and a hole 30 is located in upper cover 24 such that it is coincident with the connector 31 when the cover 24 is at the upper end of its permitted travel, limited by key 27. The hole 30 is sized to permit connector 20 to pass into engagement with connector 31.

In operation of the structure so far described, the connector 20 is pulled from housing 1 thus extending the cable. The cable is threaded through and around the articles to be secured together, and connector 20 is then inserted through hole 30 into engagement with connector 31, the pins of connector 20 making electrical contact with mating sockets of connector 31.

A plate 32 which is attached to lock 28 is shaped with a leaf, orthogonal to connector 20, which fits into groove 22 of connector 20. Once connector 20 has engaged with connector 31, passing into the lower portion of the housing, key 27 is rotated, causing the leaf of plate 32 to engage with groove 22 and thus prohibiting its retraction. Key 27 is then removed.

A loud audio alarm 33 is contained within the housing. The housing should of course be provided with a plurality of holes to allow the alarm sound to be emitted. A very strong spring attachment 35 is preferably fixed to the alarm, or to a base on which the alarm is attached, and is strongly biased against the top cover 24. The spring thus maintains the cover 24 in its upper position, that position being determined by the presence of key 27. When the cover 24 is depressed, the spring contact 35 makes contact with a fixed contact 36, which is connected to circuitry of the audio alarm. Spring 35 is also connected to circuitry of the audio alarm, and upon closure of the contact between spring 35 and contact 36, a circuit is completed, the alarm sounds and the apparatus can thereby be used as a horn.

Upon retraction of the key following locking of the connector 20 into place, the connector 20 retains the top cover in position. In this position, cover 24 cannot be depressed and the alarm horn cannot be sounded. A battery 40 is retained within the housing, held by a battery clip 41 which is fixed to the bottom cover. The battery is connected to the alarm circuitry.

As will be described below, the owner of the lock can select a unique alarm code of his own choosing, causing the alarm, when activated, to emit a coded audio sound, e.g. formed of dots and dashes. If desired, the alarm could instead or in addition emit sounds of varying pitches which would be recognized by the owner.

Should the cable be pulled, causing the reel to rotate, the lever 12 rides up on the ridges joining the straight portions of the periphery of the reel, which activates microswitch 13. Activation of the microswitch causes the alarm to sound.

Further, cutting the wire or attempting to defeat it by causing variation in the resistance also causes the alarm to sound, as will be described below. It is preferred that should the microswitch be caused to operate, the alarm would only operate for a finite period of time, such as ten seconds, since this only provides evidence of tampering, but not of theft.

Figure 6:
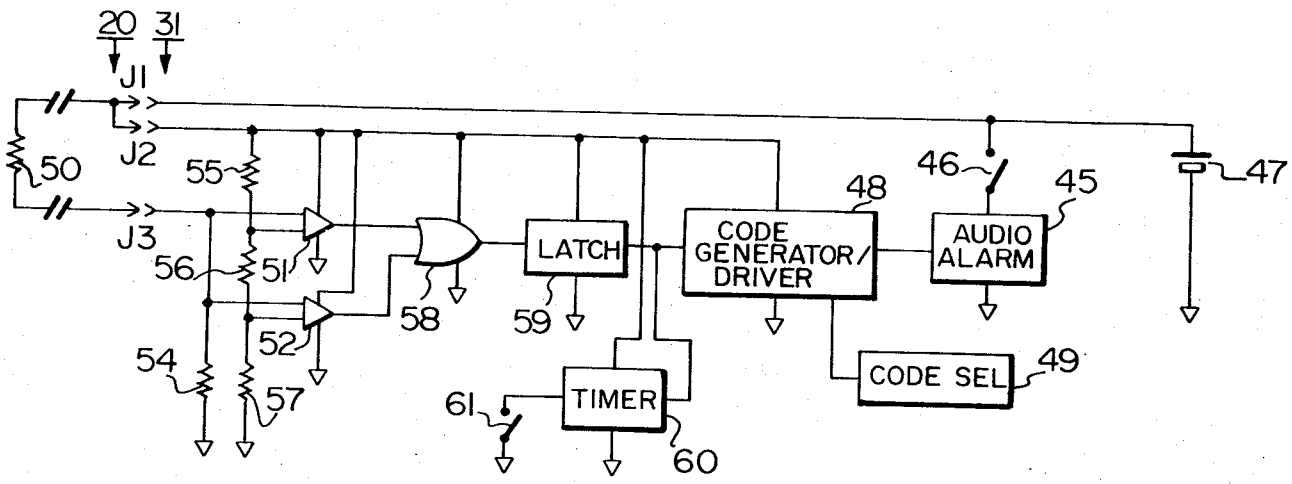
FIG. 6 is a block diagram of a preferred circuit for implementing in the invention.

Turning now to FIG. 6, a block diagram of the preferred form of the invention is shown. An audio alarm 45 (corresponding to alarm 33) provides the sound emission. Switch 46, corresponding to the contacts of spring 35 and contact 36 conducts battery current from battery 47 (corresponding to battery 40) to alarm 45. Thus when the switch 46 closes as by depressing the top cover closing the circuit between spring 35 and contact 36, a manually operated horn sound is generated.

A code generator/alarm driver 48 is also connected to audio alarm 45. The power supply lead of code generator 48 is connected to the connector 31 socket J2, the mating pin of connector 20 also labelled J2 being short circuited to connector pin J1 as desribed earlier. The socket J1 of connector 31 is connected to battery 47. Thus when connector 20 is mated with connector 31 battery power is supplied to code generator 48 and its ancillary circuitry.

Code generator 48 also has a code selector 49 connected to it. By this means, e.g. selection of a code by closing switches of a minidip switch contained within the housing, an unique code can be selected.

Resistor 50 corresponds to resistor 17 of FIG. 5. By means of the cable, the resistor connects between connector pins J1 and J2, and J3 of connector 20, and, when inserted into connection with connector 31, with the corresponding pin sockets.

A pair of comparators 51 and 52 have one of their respective inputs connected to socket J3 of connector 31, which socket is connected through resistor 54 to ground. Thus socket J3 forms the tap of a voltage divider between the source of current and ground consisting of resistors 50 and 54.

A series circuit of three resistors 55, 56, and 57 is connected between socket J2 of connector 31 and ground. The second input of comparator 51 is connected to the junction of resistors 55 and 56 and the second input of the comparator 52 is connected to the junction of resistors 56 and 57.

Outputs of comparators 51 and 52 are connected to the two inputs of OR gate 58, which has its output connected to the input of the latch 59, which has its output connected to the enable input of code generator 48.

A timer 60 (e.g. of 10–15 seconds) is connected to the enable input of code generator 48, and has its power supply input connected to socket J2 of connector 31. Switch 61 is connected between ground and the enable input of timer 60. Switch 61 corresponds to microswitch 13.

Manual operation of switch 46 to cause alarm 45 to operate as a horn has already been described. When switch 61 is operated, caused by rotation of the reel which causes operation of microswitch 13 (corresponding to switch 61), timer 60 is enabled. This causes code generator 48 to be enabled. Code generator 48 operates audio alarm 45 in accordance with the long or short pulses, or different frequencies established by code selector 49. The audio alarm operates for as long as has been set on timer 60, e.g. 10–15 seconds.

The ratios of resistors 50 and 54, and 55, 56 and 57 are established such that normally comparators 51 and 52 do not enable OR gate 58, and in the normal idle state, code generator 48 is not enabled. However, should resistance 50 vary substantially from its value, causing the inputs of comparators 51 and 52 to vary in voltage a degree in excess or less than the values set on either of their other inputs, one or the other will be enabled, operating OR gate 58, latching latch 59 and causing code generator 48 to be enabled. Its output thus causes alarm 45 to emit the coded alarm, thus alerting passersby and indicating to the owner that the lock which protects his apparatus has been broken. In this case the alarm is not timed, and will operate until the battery is depleted or the owner shuts it off by insertion of the key to release connector 20, thus removing the jumper between the sockets J1 and J2 whereby the battery is disconnected.

In an attempt to defeat the alarm, the resistance of resistor 50 can be varied by cutting the cable (increasing the resistance to infinity), or by jumpering a resistor around it. In both cases the alarm is set off.

Figure 7:
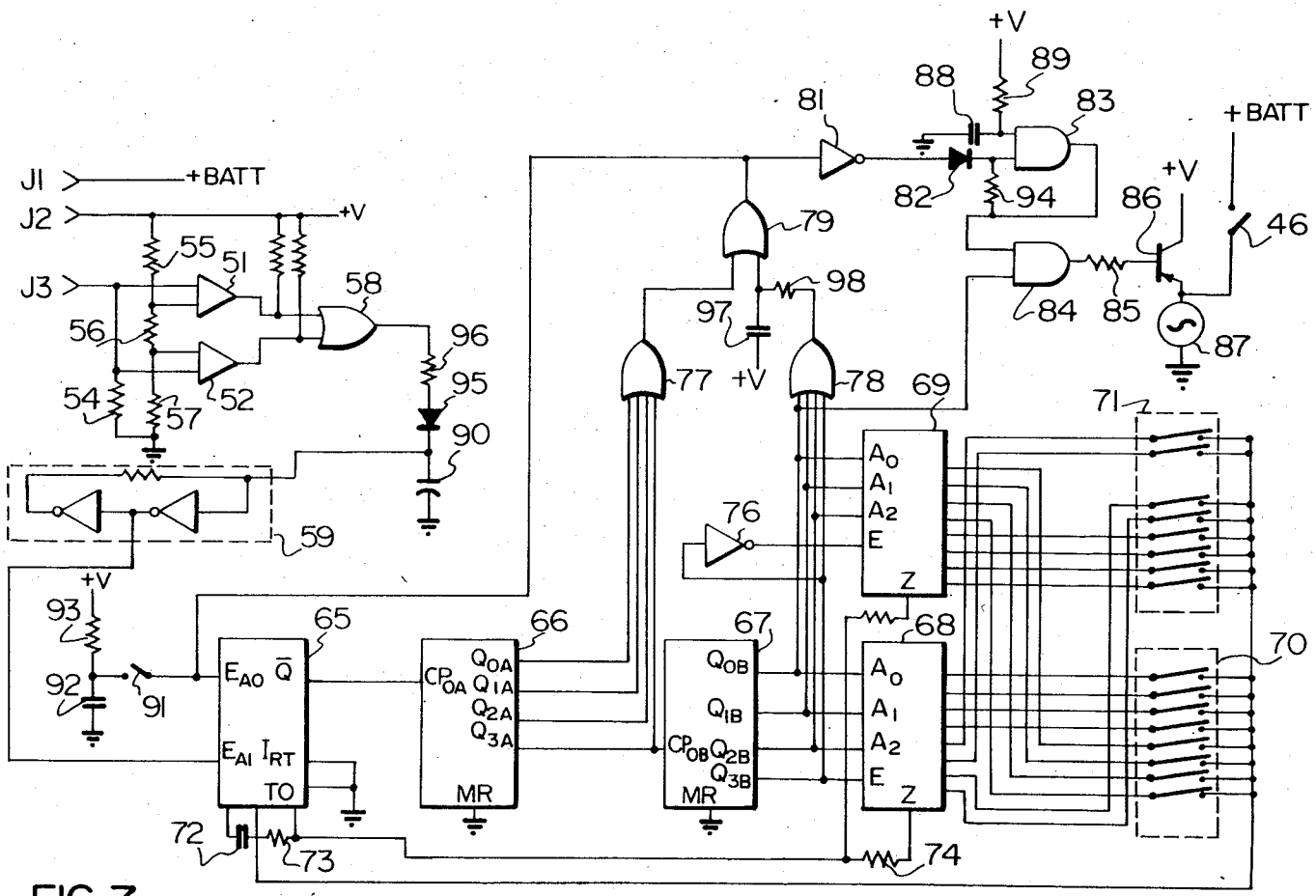
FIG. 7 is a schematic diagram of the invention according to the preferred embodiment.

FIG. 7 shows a detailed schematic diagram of the invention.

The elements 51–59 are similar to those described in FIG. 6. The output of latch 59 is connected to one input $E_{A1}$ of a multivibrator 65. Thus the multivibrator outputs a pulse signal if latch 59 locks high, should the resistance of resistor 50 vary by an amount establishing a voltage greater than the thresholds of the two comparators 51 and 52. The $\overline{Q}$ output of multivibrator 65 drives the input of a divide by 16 counter 66, the most significant bit of which drives the input of a divide by 16 counter 67. The outputs of counter 67 are individually connected to the E, $A_2$, $A_1$ and $A_0$ inputs of two eight channel multiplexers 68 and 69 in parallel except that this input to multiplexer 69 is inverted. The outputs of multiplexers 68 and 69 are connected to a pair of minidip switches 70 and 71, which have their other terminals connected together.

Multivibrator 65 has capacitor 72 and resistor 73 connected thereto in series in a well known manner, which established the time constant of the multivibrator. Resistor 74 has one terminal connected to the Z input of multiplexer 68 and resistor 75 has one input connected to the Z input of multiplexer 69. The other terminals of resistors 74 and 75 are connected together and to resistor 73. Consequently when multiplexers 68 and 69 are enabled, resistors 74 and 75 are connected through switches 70 and 71 to multivibrator 65, thereby appearing across resistor 73 and capacitor 72.

As multivibrator 65 operates, its frequency is divided by counters 66 and 67, and multiplexers 68 and 69 are enabled according to the output count of counter 67. Resistors 74 and 75 are thereby connected through switches 71 to multivibrator 65. The state of the switches in minidip switches switch 70 and 71 causes the resistors to be connected across the frequency establishing components of multivibrator 65 according to the selected code, and the closed and opened condition of the switch contacts.

An inverter 76 connects the most significant bit output of counter 67 to the E input of multiplexer 69. Thus the most significant bit drives the enable inputs of multiplexers 68 and 69; when the bit is negative multiplexer 68 is enabled and when it is positive the multiplexer 69 is enabled through inverter 76.

The outputs of counter 66 are connected to corresponding inputs of OR gate 77 and the outputs of counter 67 are connected to the inputs of OR gate 78, while the outputs of OR gates 77 and 78 are connected to inputs of OR gate 79, the output of OR gate 78 being via resistor 98, while that input of OR gate 79 is connected to capacitor 97, which is connected to V+. The output of OR gate 79 is connected through resistor 80 to the input $E_{A0}$ of multivibrator 65, to provide the second driving input thereto. The output of OR gate 79 is also connected through inverter 81 and diode 82 to an input of AND gate 83, the output of which is connected to input of AND gate 84. The least significant bit output of counter 67 is also connected to the second input of AND gate 84. The output of AND gate 84 is connected through resistor 85 to the base input of output driver transistor 86 which is connected between a horn 87 and a source of horn current +V.

The second input of AND gate 83 is connected through a capacitor 88 to ground, and through resistor 89 to +V. The input of latch 59 is also connected through capacitor 90 to ground. The input $E_{A0}$ is connected through switch 91 (corresponding to switch 61) to the junction of capacitor 92, which is also connected to ground, and resistor 93 which is connected to +V.

When the circuit is switched on, i.e. when plug 20 connects to plug 31 thus connecting J1 and J2 together, it is probable that V+ may be applied momentarily before resistor 50 balances the input voltages to comparators 51 and 52. Latch 59 is therefore prevented from operating by virtue of the delay introduced by resistor 96 and capacitor 90, only enabling the latch after resistor 50 has been firmly connected.

Similarly, it is highly probable that the spool 6 would rotate for a few seconds after connector 20 has been connected to plug 31, while the owner adjusts the cable 14. To facilitate this operation without setting off the alarm, AND gate 83 effectively mutes the alarm for a finite period of time. At the moment of switch-on, capacitor 97 momentarily holds one input of OR gate high, regardless of the state of switch 91, ensuring that multivibrator 65 commences one series of operation. While this is occurring, the input to inverter 81 is high, its output is low, and AND gate 83 is held off, disabling AND gate 84, preventing alarm 87 from sounding. Capacitor 88 and resistor 89 hold the second input to AND gate 83 low momentarily at switch-on, preventing any transitory pulse from operating AND gate 83. After counters 66 and 67 have counted through one sequence, all inputs to OR gates 77 and 78 go low, as will the output from OR gate 79. The output from inverter 81 then passes high, enabling AND gate 83, which latches itself on by means of resistor 94. Subsequent coded outputs will then cause the alarm 87 to sound, as diode 83 isolates the input to AND gate 83, regardless of the state of inverter 81.

AND gate 84 is operated with the least significant bit counted down from counter 67, which goes high during the intervals established by the minidip switches 70 and 71, switch 71 establishing the tone intervals and switch 70 establishing the blank intervals between tones.

It will be understood that resistor 15 need not be connected directly to the cable, but may be located in the circuit, i.e. between the socket J3 and the junction of the joint inputs of camparators 51 and 52. In this case the interconnecting cable can merely be a single conductor. However in this case the circuit will only be responsive to increases in resistance (i.e. caused by cutting) of the cable, and it would be vulnerable to bypassing by jumpering. For that reason the embodiment described herein is preferred.

Further, rather than or in addition to the coded audio alarm, a radio transmitter alarm can be enabled which is received by a receiver carried by the user of the lock, thus alerting him to tampering or theft.

Thus it may be seen that the principles of the invention may be achieved by variations to the preferred embodiment described herein.

Indeed, the benefits of the invention may be obtained by other variations in the structure and by other embodiments of the invention using similar principles to those described herein. All are considered to be within the sphere and scope of this invention as defined in the claims appended hereto.

I claim:

1. An alarm lock comprising:
(a) a housing containing an alarm circuit,
(b) a security cable including longitudinal conductor means,
(c) means in the housing for retaining one end of the cable,
(d) means in the housing for releasably retaining the other end of the cable, whereby the conductor means is electrically connected to arm the alarm circuit,
(c) the alarm circuit including means for repetitively emitting a predetermined coded alarm sound of a selectable group of alarm sounds upon the security cable conductor means being opened,
(d) means within the housing for retaining the cable on a spring loaded spool, and further means for enabling the alarm circuit at least for a predetermined period of time in the event the spool is rotated while said other end of the cable is retained in the housing.

2. An alarm lock comprising:
(a) a housing containing an alarm circuit,
(b) a security cable including longitudinal conductor means,
(c) means in the housing for retaining one end of the cable,
(d) means in the housing for releasably retaining the other end of the cable, whereby the conductor means is connected to arm the alarm circuit,
(e) said cable being comprised of an insulated inner conductor surrounded by a flexible protective and conductive jacket, a resistor connected between the inner conductor and conductive jacket at said one end of the cable, a first connector having one pin connected to the inner conductor and another pin connected to the jacket at the other end of the cable, the means for releasably retaining the cable including a second conductor for mating with the first connector, means connecting said pins to the alarm circuit, and
(f) the alarm circuit including means enabling the armed alarm circuit upon the security cable conductor means being interrupted, whereby an alarm signal is emitted.

3. An alarm lock comprising:
(a) a housing containing an alarm circuit,
(b) a security cable including longitudinal conductor means,
(c) means in the housing for retaining one end of the cable,
(d) means in the housing for releasably retaining the other end of the cable, whereby the conductor means is connected to arm the alarm circuit,
(e) said cable being comprised of an insulated inner conductor surrounded by a flexible protective and conductive jacket, a resistor connected between the inner conductor and conductive jacket at said one end of the cable, a first connector having one pin connected to the inner conductor and another pin connected to the jacket at the other end of the cable, the connector including means for connecting a source of operating power in said housing to said alarm circuit, and
(f) the alarm circuit including means enabling the armed alarm circuit upon the security cable conductor means being interrupted, whereby an alarm signal is emitted.

4. An alarm lock comprising:
(a) a housing containing an alarm circuit,
(b) a security cable including longitudinal conductor means,
(d) means in the housing for releasably retaining the other end of the cable, whereby the conductor means is connected to arm the alarm circuit,
(e) said cable being comprised of an insulated inner conductor surrounded by a flexible protective and conductive jacket, a resistor connected between the inner conductor and conductive jacket at said one end of the cable, a first connector having one pin connected to the inner conductor and another pin connected to the jacket at the other end of the cable, the connector including means for connecting a source of operating power in said housing to said alarm circuit, including means within the housing for retaining the cable on a spring loaded spool, and further means for enabling the alarm circuit for a predetermined period of time in the event the spool is rotated while said other end of the cable is retained in the housing.

5. An alarm lock comprising:
(a) a housing containing an alarm circuit,
(b) a security cable including longitudinal conductor means,
(c) means in the housing for retaining one end of the cable,
(d) means in the housing for releasably retaining the other end of the cable, whereby the conductor means is connected to arm the alarm circuit,
(e) said cable being comprised of an insulated inner conductor surrounded by a flexible protective and conductive jacket, a resistor connected between the inner conductor and conductive jacket at said one end of the cable, a first connector having one pin connected to the inner conductor and another pin connected to the jacket at the other end of the cable, the means for releasably retaining the cable including a second connector for mating with the first connector, and means connecting said pins to the alarm circuit, including means in the alarm circuit for repetitively emitting a predetermined coded alarm sound upon the inner conductor being short circuited to the outer jacket.

6. An alarm lock comprising:
(a) a housing containing an alarm circuit,
(b) a security cable including longitudinal conductor means,
(c) means in the housing for retaining one end of the cable,
(d) means in the housing for releasably retaining the other end of the cable, whereby the conductor means is connected to arm the alarm circuit,
(e) said cable being comprised of an insulated inner conductor surrounded by a flexible protective and conductive jacket, a resistor connected between the inner conductor and conductive jacket at said one end of the cble, means retaining said one end of the cable on a spring loaded spool, a first connector having one pin connected to the inner conductor and another pin connected to the jacket at the other end of the cable, the means for releasably retaining the cable including a second connector for mating with the first connector, and means connecting said pins to the alarm circuit, including means in the alarm circuit for repetitively emitting a predetermined coded alarm sound upon the resistance between the inner conductor and outer jacket being varied by more than a predetermined amount.

7. An alarm lock as defined in one of claims 2–6 including means within the housing for selecting an alarm sound code formed of a series of long and short single frequency alarm sounds.

8. An alarm lock as defined in one of claims 2–6 including means for manually operating the alarm circuit to emit a single frequency alarm sound for intermittent periods of time.

* * * * *